United States Patent [19]

Coller et al.

[11] 4,077,443

[45] Mar. 7, 1978

[54] SOLDER RESIST APPLYING MACHINE

[75] Inventors: James Ray Coller, Mechanicsburg; Suel Grant Shannon, Harrisburg, both of Pa.

[73] Assignee: AMP Incorporated, Harrisburg, Pa.

[21] Appl. No.: 729,548

[22] Filed: Oct. 4, 1976

Related U.S. Application Data

[63] Continuation of Ser. No. 324,729, Jan. 18, 1973, abandoned.

[51] Int. Cl.[2] ..... B05C 7/00

[52] U.S. Cl. ..... 141/111; 118/401; 141/164; 228/215

[58] Field of Search ..... 118/401, 423, 425, 410, 118/400; 141/31, 67, 68, 110, 129, 164, 111; 228/37, 38, 39, 40, 43, 33, 114, 115

[56] References Cited

U.S. PATENT DOCUMENTS

| | | | |
|---|---|---|---|
| 2,259,557 | 10/1941 | Dummer et al. | 118/401 |
| 2,937,108 | 5/1960 | Toye | 118/401 X |
| 3,081,213 | 3/1963 | Chinn | 118/401 X |
| 3,094,914 | 6/1963 | Smith | 118/401 X |
| 3,201,275 | 8/1965 | Herrick | 118/401 X |
| 3,323,936 | 6/1967 | Tolf | 118/401 X |
| 3,587,524 | 6/1968 | Keating | 118/500 X |

OTHER PUBLICATIONS

*Western Electric Technical Digest* "Bead Chain Orienting Conveyor" Brown et al., No. 24 [Oct. 1971] pp. 7, 8.

*Primary Examiner*—Morris Kaplan
*Attorney, Agent, or Firm*—Gerald K. Kita

[57] ABSTRACT

A machine and a method for applying a solder resistant material or solder resist to predetermined portions of miniature connector structures are disclosed. The machine permits large numbers of the miniature connector structures to be precisely treated with the solder resist without the need for costly and time consuming masking procedures. More particularly, the miniature connector structures attached to a carrier strip are fed through a hybrid fluid dispensing assembly similar to a bath, which is continuously supplied with the solder resistant material. The quantity of material supplied to the hybrid fluid dispenser or bath is coordinated with the speed at which the miniature connector structures are driven through the bath so that each of the miniature structures absorbs a predetermined amount of solder resistant material by capillary action. The quantity of material absorbed by each of the miniature connector structures is controlled so that it is just sufficient to fill a desired area. The filled connectors are subsequently heated to cure the solder resistant material.

4 Claims, 7 Drawing Figures

FIG. 2
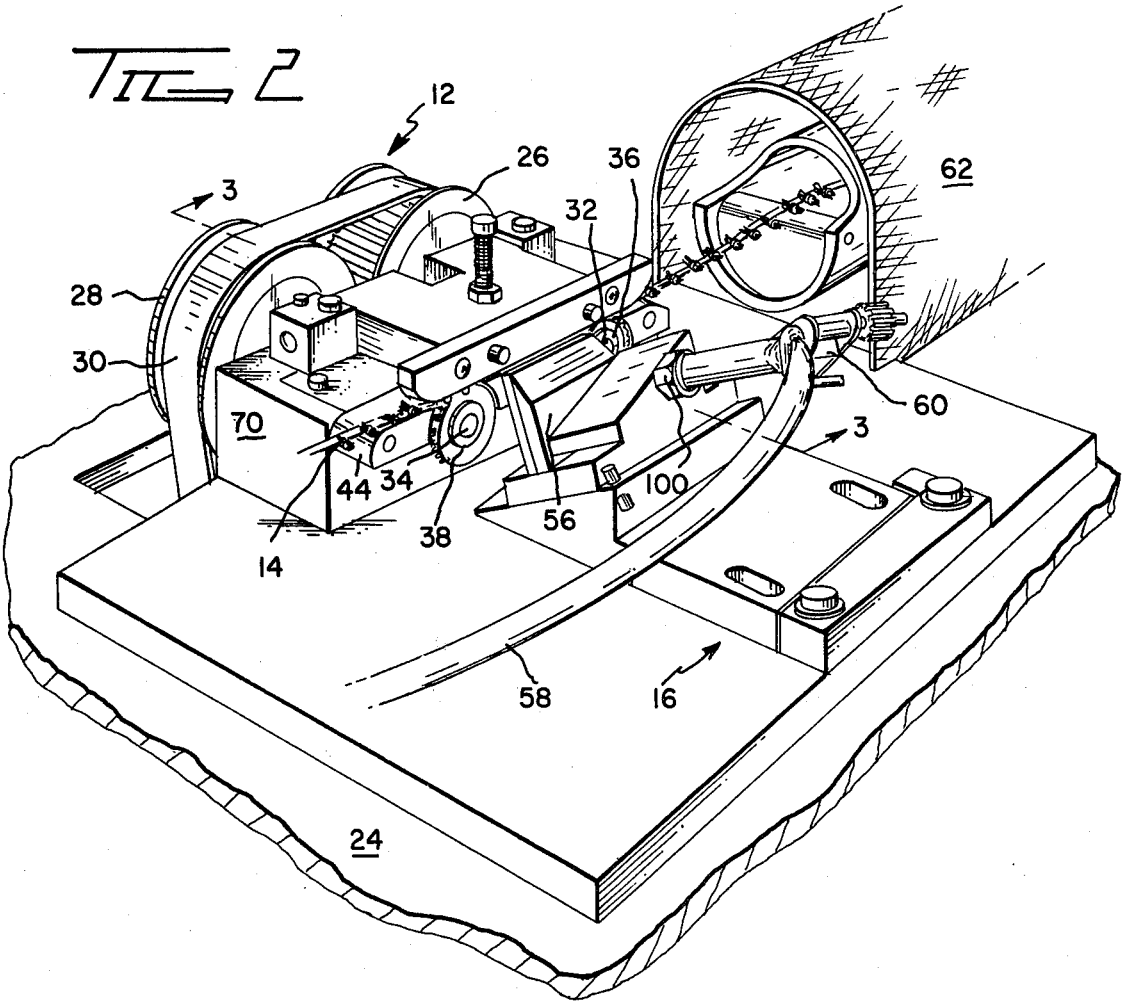
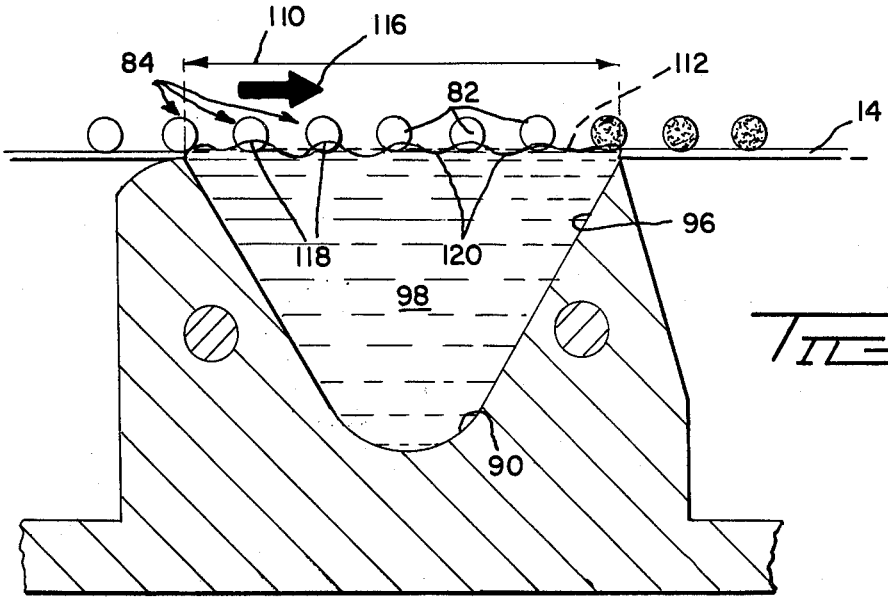
FIG. 7

FIG. 5
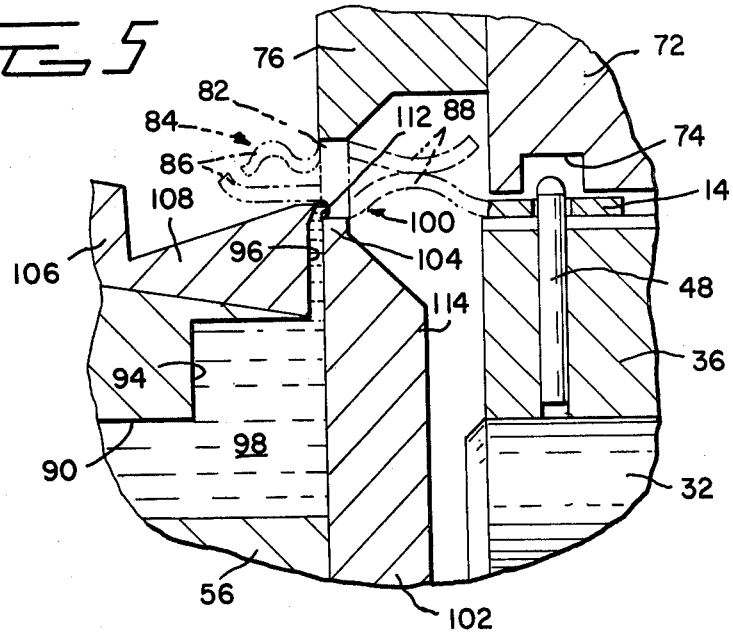
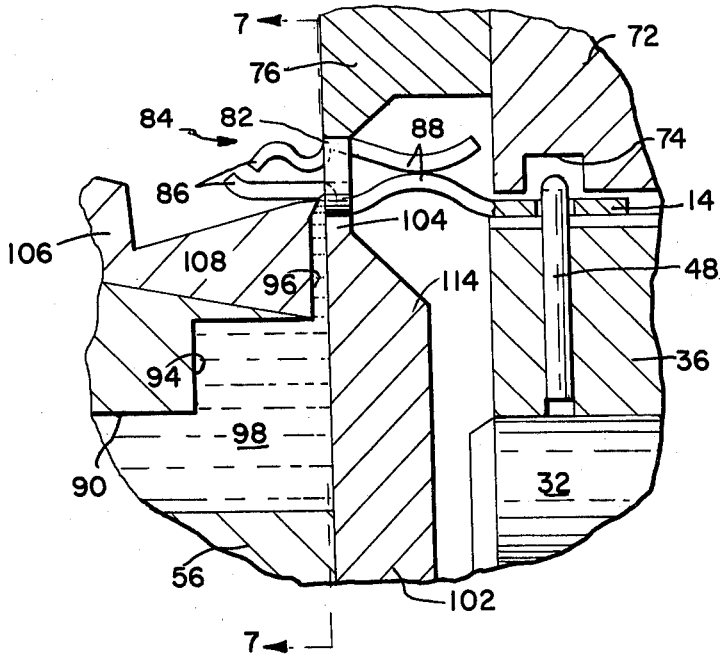
FIG. 6

SOLDER RESIST APPLYING MACHINE

CROSS REFERENCE TO RELATED APPLICATIONS

This application is a continuation of application Ser. No. 324,729, filed Jan. 18, 1973 and now abandoned.

BACKGROUND OF THE INVENTION

1. Field of the Invention

This invention relates generally to an apparatus for applying solder resist, and more particularly to a method and apparatus for applying a solder resist to miniature connector structures without need for special masking.

2. Description Of The Prior Art

Miniaturization of electronic components has created a demand for a tremendous quantity of miniature contact, terminal and connector structures. The demand for such miniature contact and connector structures has in turn created a demand for new techniques and new equipment for soldering and treating miniature electrical connectors with solder resistant coatings.

In particular, numerous problems have arisen in soldering miniature connectors and especially in confining solder to appropriate areas of a miniature connector while preventing it from flowing through all portions of the connector and thereby destroying or imparing the mechanical functioning of the connector. More specifically many miniature connectors have spring arms and the like which are designed to frictionally grip portions of electronic components and therefore must be free to move. However the small size of such connectors produces a strong wicking or capillary action in any melted solder which is applied to the connector, so that solder is often drawn throughout the connector by the wicking action, soldering the spring arms together and preventing them from functioning properly. As a result it is often necessary to apply a solder resist, or material which resists the flow of solder, to various portions of a miniature connector to combat the wicking or capillary action. Naturally the resist material must be applied with great care so that it does not touch areas of the connector where solder should adhere. To prevent application of the resist material to such areas, it has often been the practice to mask certain areas of the connector. However the small size of miniature connectors makes accurate masking a virtual impossibility unless costly and time consuming efforts are made in this regard. As a result there is a great need at the present time for a machine and a technique which permits precise and rapid application of a solder resist to miniature connectors without need for special masking.

SUMMARY OF THE INVENTION

Accordingly one object of the present invention is to provide a novel apparatus for applying a solder resist material to miniature electrical connectors.

Yet another object of this invention is to provide a novel apparatus for applying solder resist material to miniature electrical connectors without the need for special masking.

A still further object of this invention is the provision of an apparatus for rapidly and precisely applying a solder resist material to a localized area of miniature connectors.

Yet another object of this invention is the provision of a novel apparatus for drawing a large number of miniature electrical connectors through a bath of solder resist material.

Briefly, these and other objects of the invention are achieved by providing an apparatus which draws a plurality of miniature electrical connectors attached to a carrier strip through a continuously fed bath of solder resist material. The depth of exposure of the miniature connectors to the bath is carefully controlled and the speed at which the miniature connectors are drawn through the bath is synchronized with the rate at which the bath is supplied with fluid so that each miniature connector passing through the bath absorbs a precise amount of solder resist material by capillary action. The amount of solder resist material absorbed by each miniature connector is precisely regulated to be an amount just sufficient to coat the prescribed area of the connector. The objects are also achieved in accordance with the method of the present invention which includes the steps of drawing a plurality of miniature connectors through a continuously fed bath of solder resist material and synchronizing the rate at which fluid is supplied to the solder resist bath with the speed at which the miniature connectors are drawn through the bath so that each connector is permitted to absorb only a predetermined amount of solder resist material by capillary action.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is an enlarged perspective illustration of the central portion of the apparatus illustrated in FIG. 1;

FIG. 5 is an enlarged illustration of a portion of the apparatus illustrated in FIG. 3 showing in detail the manner in which solder resist material flows into the bath area;

FIG. 6 is an illustration similar to that of FIG. 5 showing a miniature connector passing through the bath area; and, FIG. 7 is an enlarged frontal view of the bath area illustrated in FIG. 6.

DESCRIPTION OF THE PREFERRED EMBODIMENTS

Figure 1:
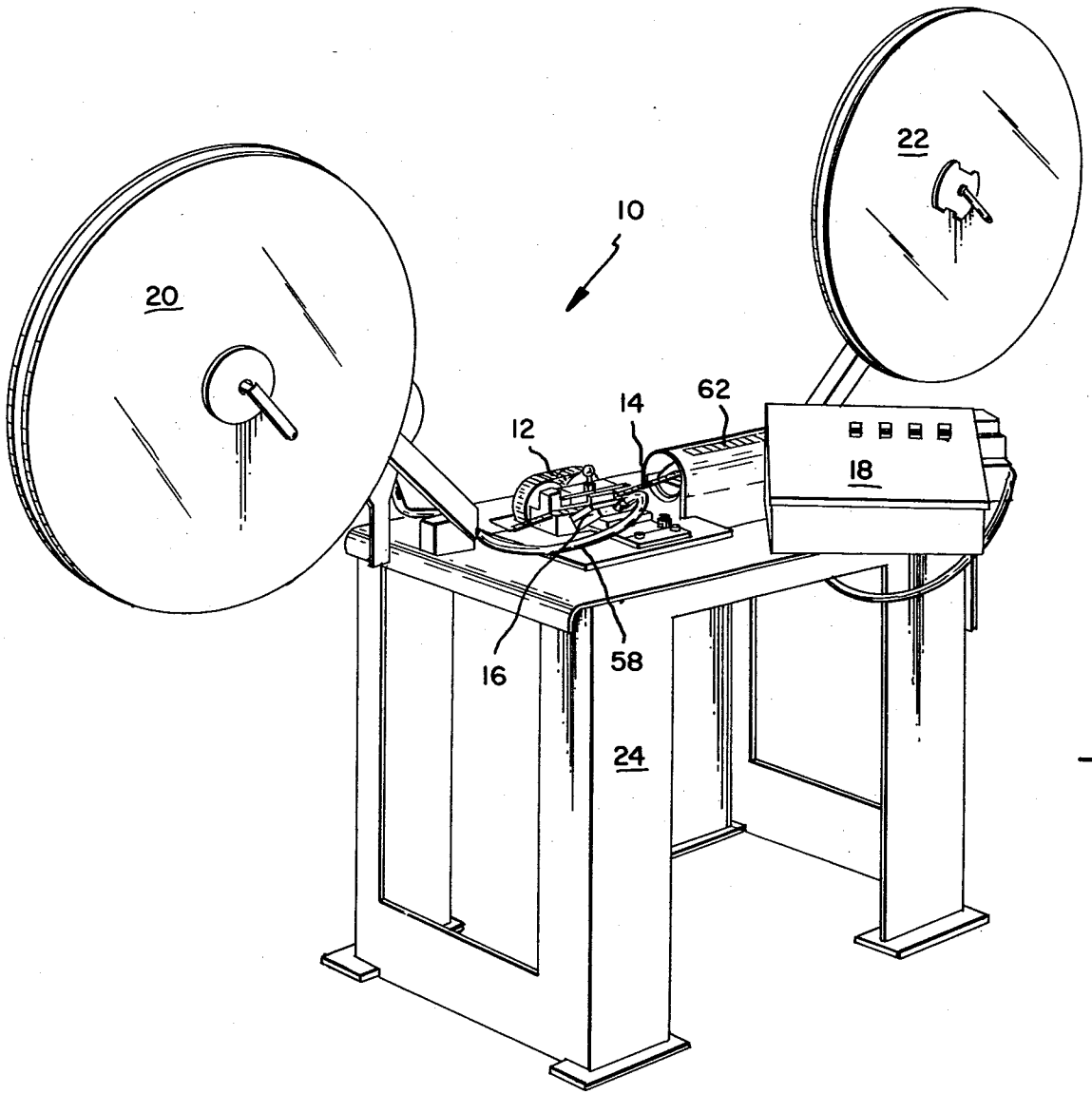
FIG. 1 is a perspective view of a preferred embodiment of the apparatus of the present invention.

Referring now to the drawings wherein like reference numerals designate identical or corresponding parts throughout the several views, and more particularly to FIG. 1 thereof, a preferred embodiment of the apparatus of the present invention is designated generally by the reference numeral 10. The apparatus 10 includes a drive mechanism 12 for feeding a web or carrier strip 14 through a bath assembly 16. A control panel 18 is provided to permit manual control of the apparatus 10. A substantial length of the web 14 is initially stored on a feed reel 20, and is eventually accummulated on a takeup reel 22. The entire apparatus is mounted on a suitable machine table 24.

Referring now to FIG. 2, the drive mechanism 12 and bath assembly 16 are shown in greater detail. The drive mechanism 12 includes a pair of pulleys 26 and 28 which preferably have grooved surfaces for cooperation with a toothed belt 30. The toothed belt 30 is driven by an appropriate variable speed electric motor (not shown). Although a toothed belt and pulley assembly is illustrated in FIG. 2, it will be apparent that conventional chain, gear and non-toothed belt drives may also be used.

The pulleys 26 and 28 are respectively coupled through a pair of drive shafts 32 and 34 to a pair of sprocket wheels 36 and 38. The sprocket wheels engage suitable apertures in the web or carrier strip 14 to provide a positive driving connection with the carrier strip 14 for feeding it through the bath assembly 16.

Figure 4:
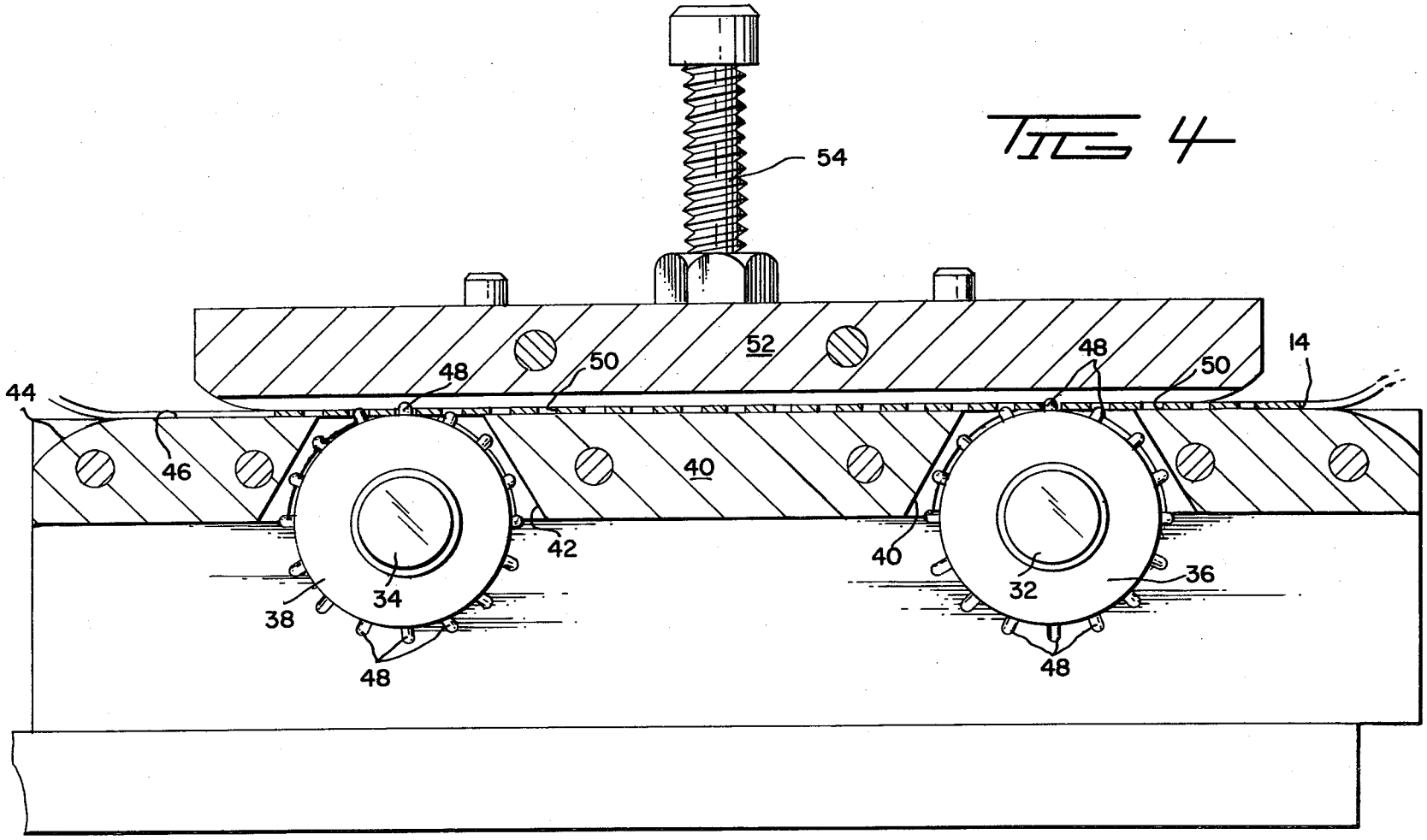
FIG. 4 is a sectional view of the sprocket drive and cover assembly of the apparatus of the present invention taken along the line 4—4 of FIG. 3.

Referring now to FIG. 4, further details of the drive mechanism 12 are illustrated more clearly. In particular, the sprocket wheels 36 and 38 are shown respectively positioned in openings 40 and 42 of a bearing plate 44. The web or carrier strip 14 is supported by and slides across an upper surface 46 of the bearing plate 44. The sprocket wheels 36 and 38 are positioned so that as they rotate their sprocket teeth 48 cyclically project about the upper surface 46 of the bearing plate 44 to enter driving apertures 50 in the web or carrier strip 14. The specific details of the web or carrier strip 14, more clearly illustrating the driving apertures 50, will be found in copending U.S. Pat. No. 3,850,000, and assigned to the same assignee as the present application. A cover plate 52, the height of which may be adjusted by means of a bolt 54, is positioned directly above the upper surface 46 of the bearing plate 44 for the purpose of maintaining the web or carrier strip 14 in proper position.

Referring again to FIG. 2, further details of the bath assembly 16 are also illustrated. In particular, a bath chamber 56 is shown positioned adjacent the bearing plate 44 between the sprocket wheels 36 and 38. A fluid supply hose 58 is coupled to the bath chamber 56 for continuously supplying a quantity of fluid to the bath chamber. A flow regulator 60 is coupled to the hose 58 in order to permit a precise control of the volume of fluid supplied through the hose. In FIG. 2 the flow regulator 60 is illustrated as a manually operable threaded clamp which is positioned around the hose 58 and is designed to permit an operator to precisely regulate the flow through the hose by adjusting the amount of pressure applied to the hose by the clamp. It will be apparent that various other types of manually operable flow regulators can also be used with the present invention, and that electrically controlled valves can also be used to regulate the flow through hose 58. Such valves are well known to those skilled in the art and are disclosed in numerous patents and other publications.

A heating tunnel 62 is positioned between the bath assembly 16 and the takeup reel 22 to heat and cure the solder resist material after it is applied to the miniature connectors carried by the web 14.

Figure 3:
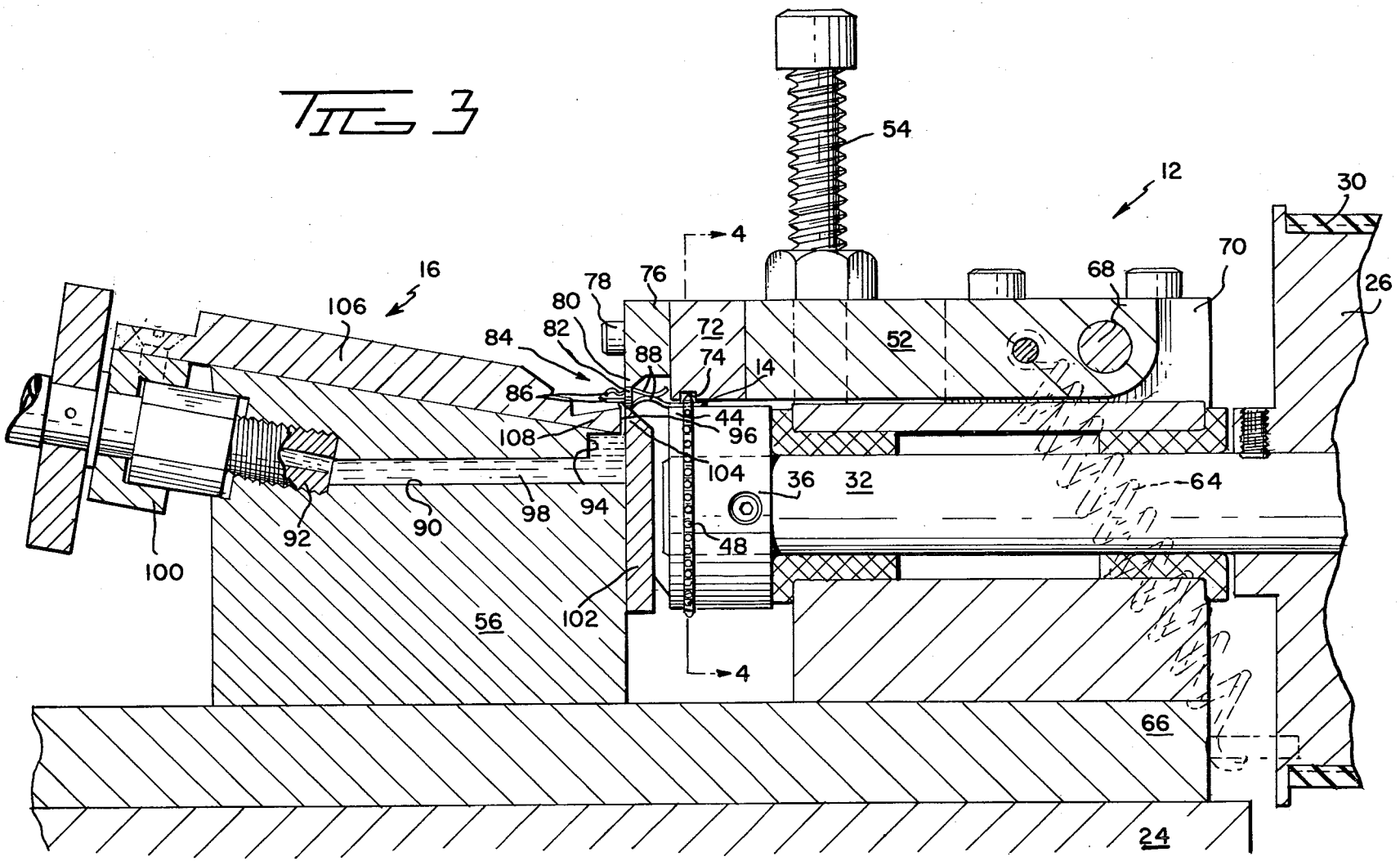
FIG. 3 is a sectional view of the apparatus of the present invention taken along the line 3—3 of FIG. 2.

Attention is now directed to FIG. 3 wherein further details of the apparatus of the present invention are illustrated. More particularly, a biasing spring 64 is shown in phantom form coupled between the cover plate 54 and a base plate 66 which rests on machine table 24. The biasing spring 64, which is a coil spring, biases the cover plate 52 toward the sprocket wheel 36 and thereby tends to press the carrier strip 14 against the sprocket wheel. The cover plate 52 is shown as including a pivot member 68 which rotatably mounts the cover plate to a frame block 70 of the drive assembly 12. The cover plate 52 also includes a web bearing segment 72 which rides directly on the web or carrier strip 14, and which includes a rectangular gap for permitting the sprocket teeth 48 of the sprocket wheels 36 and 38 to pass through it. A connector guide 76 is attached to the web bearing element 72 and to the cover plate 52 by means of a suitable bolt or fastening member 78. The connector guide 76 includes a downwardly extending tapered portion 80 which engages a barrel or main body portion 82 of each of a plurality of miniature connectors 84 which pass through the bath assembly 16 carried by the web or carrier strip 14.

Each of the miniature connectors 84 is, of course, connected to the web or carrier strip 14 to facilitate rapid handling of the connectors. The precise structure of the connectors is described in the above referenced U.S. Pat. No. 3,850,500. The connectors 84 include a pair of curved posts 86 and a pair of spring legs 88, illustrated in greater detail in FIG. 6. The curved posts 86 and the spring legs 88 are coupled to the barrel or main body portion 84 of the connectors. Again, these features are explained in greater detail in the above referenced copending patent application.

Referring again to FIG. 3, the bath assembly 16 and the bath chamber 56 are illustrated in greater detail. More particularly the bath chamber 56 is shown as a substantially solid block of metal, or another equivalent structural material having a fluid reservoir 90 therein. The fluid reservoir 90 is in the form of an elongated channel having a fluid input fitting 92 positioned at one end thereof and having an enlarged reservoir portion 94 located at the other end thereof. A fluid dispensing channel 96 communicates with the enlarged reservoir portion 94 for dispensing solder resist material 98 contained in the reservoir. The fluid input fitting 92 is connected through a suitable fluid tight coupler 100 to the fluid supply hose 58 for supplying a continuous flow of solder resist material 98 to the reservoir 90.

Although particular shapes have been shown for the fluid reservoir 90 and the fluid supply hose and associated fittings, it will be apparent that different shapes may be equally suitable for the fluid reservoir and different types of conventional fluid suppy plumbing can be used in place of the illustrated fluid supply fittings. In addition, although the fluid dispensing channel 96 is shown extending upward vertically from the main reservoir body 90, the fluid dispensing channel may be angled into the main fluid reservoir body 90, and the enlarged reservoir portion 94 may be omitted to smooth the flow of solder resist material. Various other modifications to the reservoir and dispensing channel are possible within the scope of the present invention, and are within ordinary skill in the art.

A support plate 102 is firmly mounted to the bath chamber 56, and includes a tapered upper portion 104 for engaging and supporting the miniature connectors as they pass through the bath assembly 16. Thus the tapered upper portion 104 of the support plate 102 cooperates with the tapered portion 80 of the connector guide 76 to regulate precisely the path of the miniature connectors 84 as they pass through the bath assembly 16.

A dispensing plate 106 is mounted to the top of the bath chamber 56 and includes a generally triangular shaped end piece 108 which forms one wall of the fluid dispensing channel 96.

Attention is now directed to FIG. 5 wherein the details of the dispensing area of the bath assembly 16 are shown greatly enlarged. A continuous supply of solder resist material 98 is supplied to the fluid reservoir 90, as pointed out hereinabove. The continuously supplied fluid flows through the fluid reservoir 90 and eventually flows out through the fluid dispensing channel 96 into a bath or dispensing area 110 defined between the tapered upper portion 104 of the support plate 102 and an upper corner of the triangular shaped end piece 108 of the dispensing plate 106. Fluid is supplied to the reservoir 90 at a carefully controlled rate so that the solder resist material in the fluid dispensing channel 96 is not sprayed into the bath area 110, but flows into the bath area at a limited rate such that an elongated fluid droplet 112 is formed by surface tension along the dispensing area 110. As shown in FIG. 5, the structural elements defining the output end of the fluid dispensing channel 96 are so shaped that the fluid droplet 112 extends outwardly into the path of the barrel portions 82 of the miniature connectors 84 being driven through the bath assembly. In FIG. 5 the miniature connector 84 is shown by a dashed line, indicating that the connector 84 has not yet reached the dispensing area 110, thereby permitting the fluid globual 112 to develop without interference. If the drive mechanism 12 is stopped so that none of the miniature connectors 84 pass through the bath assembly 16, the fluid droplet 112 gradually expands until it flows over the tapered upper portion 104 of the support plate 105 and trickles down the inclined rear surface 114 of the support plate 102 to be either discarded or recycled by a suitable conventional fluid handling system (not shown).

However in normal operation, as shown in FIGS. 6 and 7 a plurality of miniature connectors 84 are continuously driven through the bath assembly 16 by the carrier strip 14 to which they are attached. The fluid forming the droplet 112 is thus continuously absorbed by wicking or capillary action into the barrel or main body portions 82 of the miniature connectors 84 in a manner described below.

Referring now to FIG. 7, it will be apparent that in normal operation a plurality of miniature connectors 84 are within the bath or dispensing area 110. Before the miniature connectors are driven into the dispensing area 110, however, the continuous fluid droplet 112 forms across the entire width of the dispensing area. When the miniature connectors 84 move through the bath or dispensing area 110 the surface tension pattern is naturally disturbed, and the result is a convex meniscus or droplet 118 formed where each miniature connector 84 contacts the solder resist material 98. The menisci 118 are separated by shallow throughs 120, so that the average amount of material in the original continuous fluid 112 remains in the dispensing area 110, but is redistributed in the form of discrete, localized droplets, each associated with a particular connector 84.

FIG. 7 illustrates a frontal view of the bath or dispensing area 110 taken along the line 7—7 of FIG. 6. As shown in FIG. 7, the fluid reservoir 90 has a generally V-shaped cross sectional configuration in the area of the fluid dispensing channel 96. Accordingly, while the fluid dispensing channel 96 is narrow wnen viewed from the side as in FIGS. 5 and 6, it has a substantial width parallel to the direction in which the web or carrier strip 14 is moving. This direction is illustrated by an arrow 116 in FIG. 7. It is the extended width of the dispensing channel 96 which causes the fluid dispensing apparatus of the present invention to be similar to a "bath". However the dispensing apparatus of the present invention is actually a hybrid technique which combines certain aspects of a conventional fluid "bath" and certain aspects of a discrete quantity dispenser. More particularly the miniature connectors 84 are continuously exposed to a quantity of solder resist materials for a predetermined time interval and over a predetermined distance in their path through the apparatus of the present invention. These aspects of the fluid treating apparatus of the present invention are similar to the characteristics of a conventional "bath" type treatment. However, since the present invention also relies upon the formation of discrete fluid droplets 118, and relies upon the absorption of only a single one of these droplets by each miniature connector, the present invention also includes many aspects of a discrete quantity dispenser. Thus it will be appreciated by those skilled in the art that although many components of the apparatus of the present invention have been described as "bath" components, the fluid dispensing method of the present invention does not comprise a conventional "bath" treatment, but in fact includes a hybrid fluid dispensing technique which combines certain characteristics of a bath and certain characteristics of discrete quantity fluid dispensing.

As was pointed out hereinabove it is most important that only the barrel or main body portion 82 of each miniature connector 84 be filled with the solder resist material, since it is only in this area wherein the flow of solder is to be prevented. If too much solder resist material is permitted to flow into the bath or dispensing area 110, it will be apparent from FIG. 6 that this material will not only fill the barrel portion 82, it will also flow outwardly between the curved posts 86 and the spring legs 88 due to capillary or wicking action. Similarly, if too little resist material is permitted to flow, the barrel portion 82 of each miniature connector 84 will not be properly filled with the resist material, and an imperfect blockage of solder flow will result. A possible technique of avoiding this dilemma would be to supply a large quantity of fluid to the bath or dispensing area and provide special masking of the curved posts 86 and the spring legs 88. This technique would be extremely costly and delicate, and would be difficult to control effectively in view of the extremely small dimensions of the miniature connectors 84, and in view of the subsequent difficulty in controlling wicking or capillary action. In contrast, the solution offered by the present invention is extremely effective, precise, economical and easily controlled.

According to the present invention the volume of the barrel portion 82 of each of the miniature connectors is first measured or calculated. The number of miniature connectors per inch of carrier strip 14, the speed of the carrier strip 14 and the width of the bath or dispensing area 110 are then either set at predetermined values or calculated. When these factors are determined, the total volume of the barrel portions 82 passing through the bath or dispensing area 110 in a given interval of time is known. Since it is desired to fill this volume with the solder resist material 98, precisely this volume of solder resist material 98 must be supplied to the fluid reservoir 90 per unit time. In practice the volume of each barrel portion 82, the number of miniature connectors per inch of carrier strip 14 and the width of the dispensing area 110 are fixed, so that the drive speed of the carrier strip 14 and the rate at which fluid is supplied to the reservoir 90 are the only variable factors. If the carrier strip drive speed is thus set a predetermined value, the rate at which fluid is supplied to the reservoir 90 can be selected to the appropriate value by adjusting the flow regulator 60. Once the speed of the carrier strip 14 and the fluid supply rate are thus synchronized, the previously described hybrid fluid dispensing technique causes the solder resist material 98 to be divided into discrete fluid droplets each having precisely the correct volume to fill a single barrel portion 82. Consequently the barrel portion of each miniature connector is completely filled with solder resist material 98 upon leaving the bath or dispensing area 110. Since the quantity of fluid supplied to each barrel portion 82 is precisely sufficient to fill the barrel portion, no fluid remains to be carried out along the curved posts 86 or the spring legs 88 by wicking or capillary action. As a result, the present invention eliminates the need for special masking of the miniature connectors 84.

By way of specific example, the width of the bath or dispensing area 110 may be on the order of 1.5 inches and the diameters of the barrel portions 82 of the miniature connectors 84 may be on the order of 0.125 inches. Obviously, the present invention is not limited by any precise dimensions, and can be practiced using miniature connectors or other similar structures of various sizes. 120, After the miniature connectors are driven through the bath assembly 16 and are appropriately filled with the solder resist material 98, they are transported through the heating tunnel 62 to permit appropriate curing of the solder resist material. In the heating tunnel the solder resist material is dried, and becomes firmly adhered to the inner surface of the barrel portion 82 of each miniature connector.

The solder resist material 98 is a solder resistant coating, as pointed out hereinabove. The resist material includes a commercially available coating composition which has the following characteristics:

Viscosity: 5.00 poises at + 25° C
Specific Gravity: 0.916 at +25° C
Physical Nature: Wax film
Cure Time: 2 hours at +25° C This material can be commercially obtained from Dow-Corning Corp. of Midland, Mich., and is known as composition No. 630. Alternatively a composition having the same physical characteristics can be produced using known ingredients.

The above described coating material is mixed with a xyene solvent and with an appropriate pigment to form the solder resist material 98. The xyene solvent may be commercially obtained from North Chemical Company of York, Pa. The pigment is preferably an inorganic pigment having an orange color. The pigment can be obtained from any number of sources, and can be virtually any color and can have different chemical properties. Its function is simply to give an easily recognizable visual characteristic to the solder resist material so that it can be easily seen and recognized. The quantities of the above noted materials used in formulating the solder resist material 98 are as follows:

Coating Material: 1 pint
Xyene Solvent: 1 pint
Pigment: ¼ teaspoon

Essentially any quantity of solder resist material can be formulated using the relative measurements set forth above.

The apparatus for applying solder resist material according to the present invention is described throughout the foregoing disclosure. However, to recapitulate, a plurality of miniature connectors or equivalent structures are first formed integral with or fastened to a suitable transporting web. The volume of the portion of each miniature connector or equivalent structure which is to be filled with solder resist or an equivalent material is calculated or set, as is the number of such structures per unit distance of the transporting web. A hybrid dispensing facility (i.e. one combining certain characteristics of a bath and certain characteristics of a discrete point and discrete quantity dispensing technique, described above) of a predetermined width is then prepared. The web is then driven at a selected speed so that the structures to be coated pass through the dispensing area at a predetermined rate. Once the rate is selected, a known volume to be filled with solder resist material passes through the dispensing area in a unit time interval. Solder resist material is continuously supplied to a fluid reservoir connected to the dispensing area at a rate which equates the volume of fluid supplied to the dispensing area with the volume of the structures to be filled with resist material. The structure of the dispensing area forms the solder resist material along an orifice to be divided into individual droplets by a wicking action into each ot the structures passing through the dispensing area, and each of the droplets includes a volume of fluid which is precisely equivalent to the volume of the structure to be filled. The coating material is then drawn into the passing structure by wicking or capillary action to precisely fill the desired area of the passing structure, without overflowing or spreading to other areas of the passing structure. Thus a method of coating only predetermined areas of miniature connectors with a solder resist material without need for special masking is disclosed. Each connector or structure is fabricated with its main barrel portion 84 in the form of a loop. As shown, the loop is enclosed in a cylindrical configuration. However, it may take the form of a cylinder open along its curved surface or the form of a U-shaped bight. If the loop is purposely formed on the connector in a desired location, the solder resist will be located precisely internally of the loop and in desired location along the connector length. The loop portion should be of sufficient size to retain in place the liquid resist capillary action, the viscosity and adhering properties of the resist limiting the permissible size of the loop. When the resist is dried, by heating, for example, the loop portion will become internally coated with resist which provides a solder stop-off resisting flow of solder along the connector when solder is applied to the connector. For example, the loop portion 82 of the connector shown is also utilized as a base supporting the connector in a printed circuit board as described in U.S. patent application Ser. No. 288,852, filed Sept. 11, 1972, and now U.S. Pat. No. 3,850,500. The solder stop-off eliminates the extreme care heretofore required when applying solder selectively to the connector. The connector may be partially dipped in a wave soldering machine without the pressure of the solder wave forcing solder beyond the resist stop-off in the barrel portion 82 of the connector.

Obviously, numerous modifications and variations of the present invention are possible in light of the above teachings. It is therefore to be understood that within the scope of the appended claims, the invention may be practiced otherwise than as specifically described herein.

What is claimed is:

1. Apparatus for applying solder resistive fluid in discrete quantities to a plurality of serially arranged electrical contacts without a need for masking, comprising:

a fluid reservoir containing a supply of fluid material, dispensing means adjacent said reservoir for transferring discrete quantities of fluid material from said fluid reservoir to a plurality of electrical contacts serially transported to said dispensing means, drive means for transporting said electrical contacts serially to said dispensing station, fluid supply means for supplying fluid material to said reservoir, thereby replenishing the discrete quantities of fluid transferred to said electrical contacts, and adjustable flow regulating means for controlling the rate at which fluid is replenished from said fluid supply means to said reservoir, said dispensing means including a fluid dispensing elongated channel along which said electrical contacts are transported by said drive means, said dispensing means being filled with said fluid material and forming an elongated droplet of fluid material which is lengthwise of said channel and which is raised outwardly of said channel by fluid surface tension, one lengthwise side of said channel having means operatively associated therewith for biasing said elongated droplet transversely whereby to impinge said contacts transported serially along said channel.

2. The structure recited in claim 1, wherein, another lengthwise side of said channel provides means for supporting said contacts transported serially along said channel.

3. The structure as recited in claim 1, wherein, said drive means transports said contacts serially along said channel lengthwise thereof and into impingement with said droplet causing transfer of fluid in said droplet to said contacts.

4. The structure as recited in claim 1, and further including: a heat applying station whereat heat is applied to said contacts to dry said applied quantities of fluid, said drive means transporting said contacts serially from said dispensing station to said heat applying station.

* * * * *